US005330667A

United States Patent [19]

Tiffany, III et al.

[11] Patent Number: 5,330,667

[45] Date of Patent: Jul. 19, 1994

[54] TWO-CYCLE OIL ADDITIVE

[75] Inventors: George M. Tiffany, III, Houston, Tex.; Jack Ryer, East Brunswick; Renee M. Roper, Manalapan, both of N.J.; William H. Stover, Sarnia, Canada

[73] Assignee: Exxon Chemical Patents Inc., Linden, N.J.

[21] Appl. No.: 869,282

[22] Filed: Apr. 15, 1992

[51] Int. Cl.[5] ..... C10M 139/00

[52] U.S. Cl. ..... 252/49.6; 252/32.5; 252/48.2; 252/51.5 A

[58] Field of Search ..... 252/49.6, 515 A

[56] References Cited

U.S. PATENT DOCUMENTS

| | | | |
|---|---|---|---|
| 2,278,445 | 4/1942 | Hull | 196/10 |
| 2,301,052 | 11/1942 | Kirn et al. | 196/10 |
| 2,318,719 | 5/1943 | Schneider et al. | 196/10 |
| 2,329,714 | 9/1943 | Grasshof | 196/10 |
| 2,345,574 | 4/1944 | Burk | 260/683.15 |
| 2,422,443 | 6/1947 | Smith | 196/78 |
| 2,568,876 | 9/1951 | White et al. | 106/14 |
| 3,024,195 | 3/1962 | Drummond et al. | 252/51.5 |
| 3,024,237 | 3/1962 | Drummond et al. | 260/268 |
| 3,087,936 | 4/1963 | Le Suer | 260/326.3 |
| 3,110,673 | 11/1963 | Benoit, Jr. | 252/51.5 |
| 3,154,560 | 10/1964 | Kirkwood | 260/326.3 |
| 3,163,603 | 12/1964 | Le Suer | 252/33.6 |
| 3,172,892 | 3/1965 | Le Suer et al. | 260/326.5 |
| 3,202,678 | 8/1965 | Stuart et al. | 26/326.5 |
| 3,216,936 | 11/1965 | Le Suer | 252/32.7 |
| 3,219,666 | 11/1965 | Norman et al. | 260/268 |
| 3,254,025 | 5/1966 | Le Suer | 252/32.7 |
| 3,272,746 | 9/1966 | Le Suer et al. | 252/47.5 |
| 3,306,907 | 2/1967 | McNinch | 260/326.3 |
| 3,340,281 | 9/1967 | Brannen, Jr. | 260/404.5 |
| 3,346,354 | 10/1967 | Kautsky et al. | 44/63 |
| 3,929,654 | 12/1975 | Brewster et al. | 252/48.2 |
| 4,200,545 | 4/1980 | Clason et al. | 252/33.4 |
| 4,234,435 | 11/1980 | Meinhardt et al. | 252/51.5 A |
| 4,663,063 | 5/1987 | Davis | 252/51.5 R |
| 4,705,643 | 11/1987 | Nemo | 252/51.5 A |
| 4,708,809 | 11/1987 | Davis | 252/33.4 |
| 4,780,111 | 10/1988 | Dorer et al. | 44/71 |

FOREIGN PATENT DOCUMENTS 591283 9/1947 United Kingdom .

OTHER PUBLICATIONS

"A New Challenge for High-Performance Two-Cycle Engine Oils", Part-II: Biodegradable Oil Published by: Society of Automotive Engineers of Japan, Inc., Japan Oct. 1991, in 1991 Small Engine Technology Conference Proceedings, pp. 439-448 Authors: Mineo Kagaya, Mitsuaki Ishimaru, Hiroaki Ishii and Noboru Ishida.

Ethylene Amines in Encyclopedia of Chemical Technology Kirk-Othmer, vol. 5, pp. 898-905, Interscience Publishers, N.Y. (1950).

*Primary Examiner*—Ellen M. McAvoy

*Attorney, Agent, or Firm*—V. T. White

[57] ABSTRACT

A two-cycle oil additive composition and concentrate having improved detergency, lubricity and antiwear properties which more effectively controls deposits related to ring sticking comprising A) at least one dispersant prepared by reacting a carboxylic acid acylating agent with a polyalkylene polyamine and optionally a high molecular weight acylating agent; B) a second dispersant which is a succinimide such as prepared by acylating a polyalkylene polyamine with polyisobutylene succinic anhydride; and C) at least one polyolefin; at least one of the dispersants being a borated dispersant and which further optionally comprise at least one of the following: D) a sulfurized alkylphenol; and E) a phosphorous-containing antiwear agent.

39 Claims, No Drawings

TWO-CYCLE OIL ADDITIVE

BACKGROUND OF THE INVENTION

The invention relates to an additive composition for two-cycle oils and concentrates containing said additive package and a method of preparing the additive composition or concentrates. The additive composition, when incorporated into two-cycle oils, provides greatly improved engine cleanliness, particularly with regard to ring sticking, and improved lubricity and antiwear performance.

Two-cycle (two-stroke) internal combustion engines, including rotary engines are found in power lawn mowers and other power-operated gardening equipment, power chain saws, pumps, electrical generators, marine outboard engines, snowmobiles, motorcycles, and the like. Two-cycle engines employed as such are operated by mixing the fuel and the two-cycle oil in prescribed proportions. The two-cycle oil additive of the instant invention is designed for use in most types of two-cycle engines and particularly in water-cooled marine outboard engines.

Two-cycle engines are lubricated by mixing the lubricant with the fuel for the engine. The mixture of fuel and lubricant passes through the crankcase of a two-cycle engine, where it lubricates the moving parts in the lower portion of the engine and then flows through intake ports into the combustion chamber. There it lubricates the cylinder zone of the engine and is burned. The combustion products are vented from the combustion chambers through exhaust ports. As a consequence, a satisfactory lubricant for a two-cycle engine must not only provide adequate lubrication for moving engine parts but also must be able to pass into the combustion chamber leaving no objectionable deposits in the intake ports; must burn cleanly to avoid fouling the combustion chamber and spark plug with undesirable deposits; control varnish and sludge formation which leads to ring sticking and in turn to failure of the sealing function of piston rings; and must not result in plugging of the exhaust ports.

The increasing severity of the conditions under which two-cycle engines operate has led to increasing demands for oils to adequately lubricate such engines. Alleviation of the problems has been through the provision of more effective additives for two-cycle engine oils and oil fuel combinations.

The largest and most expensive two-cycle engines are the water-cooled outboards used in marine applications. Engines with up to six cylinders and horse-power ratings to 300 are now available.

In recent years, these engines have shown an increasing tendency towards premature failure via deposit related piston-ring sticking. This may be in part due to a deterioration in fuel quality, both in terms of deposit forming tendency and motor octane number, which has occurred in some areas of the United States as a result of the change to unleaded fuel. Engine changes aimed at increased out-put, improved fuel economy and reduced emissions also may have aggravated the ring sticking problem.

It is known to use acylated nitrogen-containing compounds as dispersants in two-cycle lubricants to prevent the deposition of solid materials on engine surfaces in contact with the lubricating composition. Such acylated nitrogen-containing compounds, as for instance the reaction product of isostearic acid and a polyamine, are disclosed in U.S. Pat. No. 3,110,673 and 4,705,643.

U.S. Pat. No. 3,110,673 mentioned above discloses a lubricant composition containing a pour point depressant and ashless dispersant. The ashless dispersant is described as the reaction product of a polyalkylene amine and a mixed, branched and straight chain acid.

U.S. Pat. No. 4,705,643 also briefly discussed above described an ashless lubricating two-cycle oil-additive comprised of the condensation reaction product of a branched isostearic acid and tetraethylene pentamine.

U.S. Pat. No. 2,568,876 discloses the use of organic nitrogen compounds as corrosion inhibiting compositions. The organic nitrogen compound disclosed are reaction products of monocarboxylic acids and polyalkylene polyamines having one more nitrogen atom per molecule than there are alkylene groups in the molecule, which are further reacted with an alkenyl succinic acid anhydride. The ratio of alkenyl succinic acid to monocarboxylic acid disclosed is 1:1 to 4:1 and the alkenyl radical carbon range disclosed preferably range from 8 to 18.

U.S. Pat. No. 3,216,936 discloses nitrogen-containing compositions derived from the acylation of alkylene amines and is used to stabilize metal phosphorodithioates antioxidant additives in lubricating compositions. The acylated amines of the patent are prepared by heating together an alkylene amine with an acidic mixture consisting of a hydrocarbon-substituted succinic acid and an aliphatic monocarboxylic acid. The equivalent amount of succinic acid to monocarboxylic acid disclosed range from 1:0.1 to about 1:1.

U.S. Pat. Nos. 4,200,545; 4,708,809; 4,663,063; 4,708,809 and 4,780,111 all disclosed products derived from reacting first and second acylating agents comprising carboxylic acids or anhydrides with polyamines wherein the range of equivalence for the succinic acid agent to monocarboxylic acid ranges from 1:1 to 10:1.

The present invention is directed to an additive for two-cycle lubricating oils especially two-cycle oil additives for water-cooled outboard engines. The invention is further directed to an additive which is stable at low temperatures and which also provides good detergency, lubricity, antiwear and corrosion inhibition.

Copending application U.S. Ser. No. 742,955, filed Aug. 9, 1991, discloses controlling gel formation in two-cycle oil with an additive comprising a reaction product of a monocarboxylic acid, a polyalkylene polyamine and a high molecular weight acylating agent. The application further disclosed additive compositions also containing a polyolefin and a pour point depressant flow improver. Applications Docket Nos. PT-911 and PT-913 filed contemporoneously with the instant application disclosed respectively amide/imidazoline dispersants and amide/imide/imidazoline dispersants used in combination with alcohols and/or wax crystal modifiers to control gel formation in two-cycle oils. Both disclosures are incorporated herein by reference.

SUMMARY OF THE INVENTION

A two-cycle oil additive oil composition has been discovered with improved detergency, lubricity and antiwear properties. The novel additive reduces friction and extends engine life. More effective control of deposits related to ring sticking is achieved and engine cleanliness is improved. The additive composition is particularly suitable for use in water-cooled two-cycle engines. The additive composition of the invention comprises A) at least one dispersant prepared by reacting a carboxylic acid acylating agent with a polyalkylene polyamine and optionally a high molecular weight acylating agent; B) a second dispersant which is a succinimide such as prepared by acylating a polyalkylene polyamine with polyisobutylene succinic anhydride dispersant; and C) at least one polyolefin; at least one of the dispersant being a borated dispersant. The two-cycle oil additive can, in addition, further comprise at least one of the following: D) a sulfurized alkylphenol; and (E) a phosphorous-containing anti-wear agent.

DETAILED DESCRIPTION OF THE INVENTION

Broadly stated, the invention is directed to two-cycle lubricating oil additive concentrates and compositions prepared therefrom.

The additive composition is comprised of the following components:

(A) An amide/imidazoline or amide/imide/imidazoline dispersant prepared by acylating a polyalkylene polyamine with a monocarboxylic acid and optionally a high molecular weight carboxylic acid acylating agent, (B) a succinimide dispersant, and (C) at least one polyolefin thickener. Optionally the composition or concentrates include at least one of the following:

(D) a sulphurized alkylphenol, and/or (E) a phosphorus-containing antiwear additive.

Throughout this specification and claims, any reference to carboxylic acids as acylating agent is intended to include the acid-producing derivatives such as anhydrides, esters, acyl halides, and mixtures thereof unless otherwise specifically stated.

The additive composition of the invention provides a level of cleanliness in water cooled two-cycle engines that is surprisingly better than that obtained using commercially available compositions.

The two-cycle engine oil compositions of the invention comprise a major amount of an oil of lubricating viscosity. Typically this viscosity is in the range of about 20 to about 50 cst at 40° C.

These oils of lubricating viscosity can be natural or synthetic oils. Mixtures of such oils are also often useful.

Natural oils include mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful base oils.

Synthetic lubricating oils include hydrocarbon oils such as polymerized and interpolymerized olefins alkylated diphenyl ethers and alkylated diphenyl sulfides and the derivatives, analogs and homologs thereof and the like.

Oils made by polymerizing olefins of less than 5 carbon atoms and mixtures thereof are typical synthetic polymer oils. Methods of preparing such polymer oils are well known to those skilled in the art as is shown by U.S. Pat. Nos. 2,278,445; 2,301,052; 2,318,719; 2,329,714; 2,345,574; and 2,422,443.

Alkylene oxide polymers (i.e., homopolymers, interpolymers, and derivatives thereof where the terminal hydroxyl groups have been modified by esterification, etherification, etc.) constitute a class of known synthetic lubricating oils for the purpose of this invention especially for use in combination with alkanol fuels. They are exemplified by the oils prepared through polymerization of ethylene oxide or propylene oxide, the alkyl and aryl ethers of these polyoxyalkylene polymers (e.g., methyl polypropylene glycol ether having an average molecular weight of 1000, diphenyl ether of polyethylene glycol having a molecular weight of 500–1000, diethyl ether of polypropylene glycol having a molecular weight of 1000–1500, etc.) or mono- and polycarboxylic esters thereof, for example, the acetic acid esters mixed $C_3$–$C_8$ fatty acid esters, or the $C_{13}$ Oxo acid diester of tetraethylene glycol.

Another suitable class of synthetic lubricating oils comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, octyl alcohol, dodecyl alcohol, tridecyl alcohol, 2-ethylhexyl alcohol, ethylene glycol, diethylene glycol monoether, propylene glycol, etc.). Specific examples of these esters include dioctyl adipate, di(2-ethylhexyl)sebacate, di-n-hexyl fumarate, dioctyl sebacate, diisoctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{18}$ monocarboxylic acids and polyols and polyol ethers such as neopentyl glycol, trimethylol propane, pentaerythritol, dipentaerythritol, tripentaerythritol, etc.

Unrefined, refined and rerefined oils, either natural or synthetic (as well as mixtures of two or more of any of these) of the type disclosed hereinabove can be used in the lubricant compositions of the present invention. Unrefined oils are those obtained directly from a natural or synthetic source without further purification treatment. For example, a shale oil obtained directly from retorting operations, a petroleum oil obtained directly from primary distillation or an ester oil obtained directly from an esterification process and used without further treatment would be an unrefined oil. Refined oils are similar to the unrefined oils except that they have been further treated in one or more purification steps to improve one or more properties. Many such purification techniques are known to those of skill in the art such as solvent extraction, secondary distillation, acid or base extraction, filtration, percolation, etc. Rerefined oils are obtained by processes similar to those used to obtain refined oils which have been already used. Such rerefined oils are also known as reclaimed or reprocessed oils and often are additionally processed by techniques directed to removal of spent additives and oil breakdown products.

(A) The Amide/Imidazoline Dispersant

The amide/imidazoline dispersant comprises a reaction product of a monocarboxylic acid acylating agent, a polyamine and optionally a high molecular weight acylating agent. Imides are also formed when the high molecular weight acylating agent is an appropriate diacid or anhydride thereof.

Polyalkylenepolyamines

The polyalkene polyamines useful as a reactant may be generally characterized by the formula:

$$H_2N(-\underset{\underset{R^1}{|}}{R}NH)_nH$$

wherein R is a $C_2$ or $C_3$ alkylene radical or mixtures thereof; $R^1$ is H or an alkyl radical of from about 1 to about 16 carbon atoms and n is an integer of one or greater.

Preferably, n is an integer less than about 6, and the alkylene group R is ethylene or propylene. Non-limiting examples of the polyalkylenepolyamine reactants are ethylenediamine; diethylenetriamine; triethylenetetramine; tetra-ethylenepentamine; di-(methylethylene)triamine; hexa-propyleneheptamine; tri-(ethylethylene) tetramine; dipropylenetriamine; penta-(1-methylpropylene)-hexamine; hexa-(1,1-dimethyl-ethylene)-heptamine; tri-(1,2,2-trimethylethylene) tetramine; triamine; tetra- (1,3-dimethylpropylene) - pentamine; penta - (1,2-dimethyl-1-isopropylethylene) hexamine; penta - (1-methyl-2-benzylethylene)hexamine; tetra-(1-ethyl-3-benzylethylene)pentamine; tri-(1-methyl-1-phenyl-3-propylpropylene)tetramine; and tetra-(1-ethyl-2-benzylethylene)pentamine. The ethylene amines are especially useful. They are discussed in some detail under the heading "Ethylene Amines" in "Encyclopedia of Chemical Technology" Kirk and Othmer, Vol. 5, pages 898–905. Interscience Publishers, New York (1950). Such compounds are prepared most conveniently by the reaction of alkylene dihalide, e.g., ethylene dichloride, with ammonia or primary amines. This reaction results in the production of somewhat complex mixtures of alkylene amines including cyclic condensation products such as piperazine and N-alkyl substituted piperazines. These mixtures find use in the process of this invention.

Monocarboxylic Acid Acylating Agent

The carboxylic acid acylating agent utilized in the preparation of the two-cycle oil composition or concentrate of the present invention may preferably be any monocarboxylic acid having at least two carbon atoms and generally less than 40, or aromatic monocarboxylic acids or acid-producing compounds. Generally, the monocarboxylic acid suitable for use as a carboxylic acid acylating agent will have a carbon range from 8 to 40 preferably from 10 to 30.

The aromatic and the heterocyclic monocarboxylic acids, as well as the aliphatic monocarboxylic acids, are utilizable. Monocarboxylic acids containing substituent groups, are also applicable herein so long as they do not contribute to engines resting or gel formation in finished oils. However, the preferred monocarboxylic acids reactants are the aliphatic monocarboxylic acids, i.e., the branched-chain saturated or branched or straight chain unsaturated monocarboxylic acids, and the acid halides and acid anhydrides thereof. Mixtures of branched and straight chain acids can be used so long as the straight chain acid content is limited so as to not cause gel or sediment in finished oil, normally to less than 10% of the mixture. Particularly preferred are the aliphatic monocarboxylic acid reactants having a relatively long carbon chain length, such as a carbon chain length of between about 10 carbon atoms and about 30 carbon atoms. Non-limiting examples of the monocarboxylic acid reactant; acetic acid; acetic anhydride; acetyl fluoride; acetyl chloride; propionic acid; propiolic acid; propionic acid anhydride; propionyl bromide; butyric acid anhydride; isobutyric acid; crotonic acid chloride; crotonic acid anhydride; isocrotonic acid; β-ethylacrylic acid; valeric acid; acrylic acid anhydride; allyacetic acid; hexanoic acid; hexanoyl chloride; caproic acid anhydride; sorbic acid; nitrosobutyric acid; aminovaleric acid; aminohexanoic acid; heptanoic acid; heptanoic acid anhydride; 2-ethylhexanoic acid; decanoic acid; dodecanoic acid; undecylenic acid; oleic acid; heptadecanoic acid; stearic acid; isostearic acid; linoleic acid; linolenic acid; phenylstearic acid; xylylstearic acid; α-dodecyltetradecanoic acid; behenolic acid; cerotic acid; hexahydrobenzoyl bromide; furoic acid; thiophene carboxylic acid; picolinic acid; nicotinic acid; benzoic acid; benzoic acid anhydride; benzoyliodide; benzoyl chloride; toluic acid; xylic acid; toluic acid anhydride; cinnamic acid; cinnamic acid anhydride; aminocinnamic acid; salicylic acid; hydroxytoluic acid; naphthoyl chloride; and naphthoic acid.

Isostearic acid, a commercially available mixture of methyl branched $C_{18}$ carboxylic acids combining minor amounts of other acids impurities, is the preferred monocarboxylic acid acylating agent. It is also preferred that the commercial isostearic acid not have a lactone content greater than 1.0 weight percent and that the straight chain content (GC area percent analysis) be less than 10 percent and preferably less than 8 percent. In addition, the non-$C_{18}$ acid content, which is comprised mainly of $C_{12}$, $C_{14}$ and $C_{16}$ acids is preferably less than 7 percent. A preferred isostearic acid is PRISORINE® 3502 available from Unichema International of 4650 South Racine Avenue, Chicago, Ill. 60609.

The High Molecular Weight Acylating Agent

The high molecular weight acylating agent, if employed, may be comprised of at least one aliphatic or aromatic mono or dicarboxylic acid. High molecular weight as used herein defines the substituted acylating agent comprising molecular weights ($\overline{M}n$) which range from 700 to 4000 and preferably from 900 to 2500. The polymer molecular weight distribution (Mw/Mn) generally is less than 4.5:1, preferably less than 3:1 and more preferably 1.5:1 to 3:1. As indicated throughout this specification and claims, any reference to carboxylic acids as acylating agent is intended to include the acid-producing derivatives such as anhydrides, esters, acyl halides, and mixtures thereof unless otherwise specifically stated.

The acylating agent may contain polar substituents provided that the polar substituents are not present in portions sufficiently large to alter significantly the hydrocarbon character of the acylating agent exclusive of the carboxyl groups or cause excessive rusting when the finished additive is used in two-cycle oil. Typical suitable polar substituents include halo, such as chloro and bromo, oxo, oxy, formyl, sulfenyl, sulfinyl, thio, nitro, etc. Such polar substituents, if present, preferably do not exceed 10 percent by weight of the total weight of the hydrocarbon portion of the acylating agent.

Carboxylic acylating agents used to prepare the high molecular weight acylating agents are well known in the art and have been described in detail, for example, in U.S. Pat. Nos. 3,087,936; 3,163,603; 3,172,892; 3,219,666; 3,272,746; 3,306,907; 3,346,354; and 4,234,435. In the interest of brevity, these patents are incorporated herein for their disclosure of suitable mono- and polycarboxylic acid acylating agents which can be used as starting materials in the present invention.

As disclosed in the foregoing patents, there are several processes for preparing the high molecular weight acids used in this invention. Generally, the process involves the reaction of (1) an ethylenically unsaturated carboxylic acid, acid halide, or anhydride with (2) an ethylenically unsaturated hydrocarbon containing at least about 40 aliphatic carbon atoms. The ethylenically unsaturated hydrocarbon reactant can, of course, contain polar substituents, other oil-solubilizing pendant groups, and be unsaturated within the general limitations explained hereinabove. It is these hydrocarbon reactants which frequently, but not always, provide most of the aliphatic carbon atoms present in the acyl moieties of the final products.

When preparing the high molecular weight carboxylic acid acylating agent, the carboxylic acid reactant usually corresponds to the formula $$R_o-(-COOH)_n,$$

where $R_o$ can be alkyl but more frequently is characterized by the presence of at least one ethylenically unsaturated carbon-to-carbon covalent bond and n is an integer from 1 to 6 and preferably 1 or 2. The acidic reactant can also be the corresponding carboxylic acid halide, anhydride, ester, or other equivalent acylating agent and mixtures of one or more of these. Ordinarily, the total number of carbon atoms in the acidic reactant will not exceed 10 and generally will not exceed 4. Preferably the acidic reactant will have at least one ethylenic linkage in an alpha-beta position with respect to at least one carboxyl function. Exemplary acidic reactants are acrylic acid, methacrylic acid, maleic acid, maleic anhydride, succinic and succinic anhydride, fumaric acid, itaconic acid, itaconic anhydride, citraconic acid, citraconic anhydride, mesaconic acid, glutaconic acid, aconitic acid, crotonic acid, methylcrotonic acid, sorbic acid, 3-hexenoic acid, 10-decenoic acid, and the like.

As is apparent from the foregoing discussion, the high molecular weight carboxylic acid acylating agents may contain cyclic and/or aromatic groups. However, the acids are essentially aliphatic in nature and in most instances, the preferred high molecular weight acid acylating agents are aliphatically substituted succinic acid or anhydride.

The aliphatic hydrocarbon-substituted succinic acid and anhydrides are especially preferred as acylating agents used as starting materials in the present invention. These succinic acid acylating agents are readily prepared by reacting maleic anhydride with a high molecular weight olefin or a chlorinated hydrocarbon such as a chlorinated polyolefin. The reaction involves merely heating the two reactants at a temperature of about 100°-300° C., preferably, 100°-200° C. The product from such a reaction is a substituted succinic anhydride where the substituent is derived from the olefin or chlorinated hydrocarbon as described in the above-cited patents. The product may be hydrogenated to remove all or a portion of any ethylenically unsaturated covalent linkages by standard hydrogenation procedures, if desired. The substituted succinic anhydrides may be hydrolyzed by treatment with water or steam to the corresponding acid and either the anhydride or the acid may be converted to the corresponding acid halide or ester by reacting with phosphorus halide, phenols, or alcohols.

The ethylenically unsaturated hydrocarbon reactant and the chlorinated hydrocarbon reactant used in the preparation of the high molecular weight acylating agents are principally the high molecular weight, substantially saturated petroleum fractions and substantially saturated olefin polymers. The polymers that are derived from mono-olefins having from 2 to about 30 carbon atoms are preferred. The especially useful polymers are the polymers of 1-mono-olefins such as ethylene, propene, 1-butene, isobutene, 1-hexene, 1-octene, 1-decene, 1-dodecene, 2-methyl-1-heptene, 3-cyclohexyl-1-butene, and 2-methyl-5-propyl-1-hexene. Polymers of medial olefins, i.e., olefins in which the olefinic linkage is not at the terminal position, likewise are useful. These are exemplified by 2-butene, 3-pentene, and 4-octene.

The interpolymers of 1-mono-olefins such as illustrated above with each other and with other interpolymerizable olefinic substances such as aromatic olefins, cyclic olefins, and polyolefins, are also useful sources of the ethylenically unsaturated reactant. Such interpolymers include for example, those prepared by polymerizing isobutene with styrene, isobutene with butadiene, propene with isoprene, propene with isobutene, ethylene with piperylene, isobutene with p-methylstyrene, 1-hexene with 1,3-hexadiene, 1-octene with 1-hexene, 1-heptene with 1-pentene, 3-methyl-1-butene with 1-octene, 3,3-dimethyl-1-pentene with 1-hexene, isobutene with styrene and piperylene, etc.

For reasons of hydrocarbon solubility, and stability the interpolymers contemplated for use in preparing the high molecular weight acylating agents of this invention should be substantially aliphatic and substantially saturated, that is, they should contain at least about 80 percent and preferably about 95 percent, on a weight basis, of units derived from aliphatic mono-olefins. Preferably, they will contain no more than about 5 percent olefinic linkages based on the total number of the carbon-to-carbon covalent linkages present.

The chlorinated hydrocarbons and ethylenically unsaturated hydrocarbons used in the preparation of the acylating agents can have molecular weight ($\overline{M}n$) of up to about 4000 or even higher. The preferred reactants are the above-described polyolefins and chlorinated polyolefins containing an average of at least 40 carbon atoms, preferably at least 60.

The high molecular weight acylating agent may also be prepared by halogenating a high molecular weight hydrocarbon such as the above-described olefin polymers to produce a polyhalogenated product, converting the polyhalogenated product to a polynitrile, and then hydrolyzing the polynitrile. They may be prepared by oxidation of a high molecular weight polydric alcohol with potassium permanganate, nitric acid, or a similar oxidizing agent. Another method for preparing such polycarboxylic acids involves the reaction of an olefin or a polar-substituted hydrocarbon with an unsaturated polycarboxylic acid such as 2-pentene-1,3,5-tricarboxylic acid prepared by dehydration of citric acid.

High molecular weight monocarboxylic acid acrylating agent may be obtained by oxidizing a monoalcohol with potassium permanganate or by reacting a halogenated high molecular weight olefin polymer with a ketene. Another convenient method for preparing monocarboxylic acid involves the reaction of metallic sodium with an acetoacetic ester or a malonic ester of an alkanol to form a sodium derivative of the ester and the subsequent reaction of the sodium derivative with a halogenated high molecular weight hydrocarbon such as brominated wax or brominated polyisobutene.

High molecular weight monocarboxylic and polycarboxylic acid acylating agents can also be obtained by reacting chlorinated mono- and polycarboxylic acids, anhydrides, acyl halides, and the like with ethylenically unsaturated hydrocarbons or ethylenically unsaturated substituted hydrocarbons such as the polyolefins and substituted polyolefins described hereinbefore in the manner described in U.S. Pat. No. 3,340,281.

The high molecular weight monocarboxylic and polycarboxylic acid anhydrides are obtained by dehydrating the corresponding acids. Dehydration is readily accomplished by heating the acid to a temperature above about 70° C., preferably in the presence of a dehydration agent, e.g., acetic anhydride. Cyclic anhydrides are usually obtained from polycarboxylic acids having acid radicals separated by no more than three carbon atoms such as substituted succinic or glutaric acid, whereas linear anhydrides are obtained from polycarboxylic acids having the acid radicals separated by four or more carbon atoms.

The acid halides of the monocarboxylic and polycarboxylic acids can be prepared by the reaction of the acids or their anhydrides with a halogenating agent such as phosphorus tribromide, phosphorus pentachloride, or thionyl chloride.

Although it is preferred that the high molecular weight acylating agent is an aliphatic mono- or polycarboxylic acid, and more preferably a dicarboxylic acid, the substituted carboxylic acylating agent also may be prepared from aromatic mono- or polycarboxylic acid or acid-producing compound. The aromatic acids are principally mono- and dicarboxy-substituted benzene, naphthalene, anthracene, phenanthrene or like aromatic hydrocarbons. The substituted alkyl groups may contain up to about 300 carbon atoms. The aromatic acid may also contain other substituents such as hydroxy, lower alkoxy, etc. Specific examples of aromatic mono- and polycarboxylic acids and acid-producing compounds useful in preparing the high molecular weight acylating agent include benzoic acid, m-toluic acid, salicyclic acid, phthalic acid, isophthalic acid, terephthalic acid, 4-propoxy-benxoic acid, 4-methyl-benzene-1,3-dicarboxylic acid, naphthalene-1,4-dicarboxylic acid, anthracene dicarboxylic acid, 3-dodecyl-benzene-1,4-dicarboxylic acid, 2,5-diburylbenzene-1,4-dicarboxylic acid, etc. the anhydrides of the dicarboxylic acids also are useful as the substituted carboxylic acylating agent.

It is essential to the present invention, however, that when a high molecular weight carboxylic acylating agent is used to prepare the dispersant the combined acylating agents be selected to provide a total number of carbon atoms in the acylating agents which is sufficient to render the dispersant hydrocarbon-soluble. Generally, the sum of the carbon atoms in the two acylating agents will be at least about 40 carbon atoms and more generally will be at least about 175 carbon atoms. Accordingly, if the high molecular weight acylating agent contains a large number of carbon atoms, the monocarboxylic acid acylating agent does not need to contain a large number of carbon atoms.

Acylation of the polyalkylenepolyamine in the manner disclosed herein results in a variety of acylated polyalkylenepolyamine—containing molecular entities. As a result, the polyalkylenepolyamine molecules may not be completely fully acylated with the monocarboxylic acid acylating agent or both high molecular weight acylating agent and monocarboxylic acid acylating agent nor are all polyalkylene polyamine molecules acylated to the same extent. A distribution of acylated products is obtained in which the number of amine groups acylated on different amine-containing molecules ranges from zero in the extreme (no acylation) to acylation of all 1° and 2° amines (complete acylation).

Ideally, for the ashless dispersant of this invention, the distribution of acylated products is maintained as narrow as possible. Preferably, all the amine groups should not be acylated (insufficient polarity for function as a dispersant). The other extreme i.e. low acylated molecules relative to the total amine content, will result in too high polarity for satisfactory oil solubility and dispersancy and would also provide a matrix for gel formation in the finished oil.

Generally, the equivalents or molar ratio of acylating agent(s) to amine will be such that, on average, the dispersant molecules will have between 1 and 2 amine groups unreacted to provide polarity. The exact number depends on the ratio of the optional acylating agent to the monocarboxylic acid when the optional high molecular weigh acylating agent is used and the specific composition of the polyalkylenepolyamine. A molar ratio of acylating agent(s) for instance, to tetracethylene pentamine can range from 1:1 to 5:1 with a ratio of 3:1 to 4.5:1 being preferred.

The ratio of the monocarboxylic acid acylating agent to high molecular weight acylating agent (when used) should be at least 3:1, preferably from 5:1 to 59:1 and most desirably 5:1 to 12:1 and wherein the ratio of tertiary amine to total amine is at least about 0.7:1, preferably at least 0.85:1.

The equivalent weight of the polyalkylenepolyamine for purposes of acylation is based on the number of primary and secondary amine groups per molecule, and the equivalent weight of these acylating agents is based on the number of carboxy groups per molecule. To illustrate, ethylene diamine has 2 equivalents per mole, and therefore, has an average equivalent weight of ½ its molecular weight and tetraethylene pentamine has 5 equivalents per mole and therefore, has an average equivalent weight of 1/5 of its molecular weight. The monocarboxylic acids have one carboxy group, and therefore the equivalent weight of the monocarboxylic acids is its molecular weight. The succinic and aromatic dicarboxylic acid acylating agents, on the other hand, have two carboxy groups per molecule, and therefore, the equivalent weight of each is one-half its molecular weight. Frequently, the equivalent weight of the polyalkylenepolyamine is determined by its nitrogen content, and the equivalent weight of acylating agents is determined by their acidity or potential acidity as measured by the neutralization or saponification equivalents.

However, many commercially available polyalkyleneamines have some tertiary nitrogen containing groups which will not acylate. For example, commercial tetraethylene pentamine contains about 10 percent alkyl substituted piperazine rings and probably has some tertiary amine groups formed by other branching reactions during the amine synthesis. Thus, the equivalent weight for purposes of acylation calculated from total nitrogen content will be higher that is actually the case.

Equivalent weights of polyalkyleneamines can also be calculated from total amine values measured by titration with hydrochloric acid or preferably perchloric acid. However, the same limitations described above are in effect in that tertiary amine groups will titrate but not acylate.

The amide/imide/imidazoline dispersant of the invention is a complex molecule comprising oil soluble non-polar hydrocarbon containing moiety or moieties and polar unreacted amine containing moieties. For example, as discussed above for tetraethylene pentamine, the number of acylated amine groups varies in different molecules from 1 to as high as 5. The lower acylated portion of the molecules can form a matrix for gel in finished oils. This can be further exacerbated if too large a portion or the acylating groups are (1) of low molecular weight (2) are straight-chain and (3) contain undesirable pendant groups such as hydroxyl from lactone impurities in the monocarboxylic acid. Therefore, the tendency to gel formation can be reduced by increasing the average molecular weight of the combined acylating groups and increasing the ratio of acylating groups to available amine groups. However, either of the above can be detrimental if excessive. Increasing use of high molecular weight acylation agent beyond a reasonable amount would reduce the effectiveness of the dispersant in two-cycle oil. Also, increased use of both high and low molecular weight acylating agents again beyond a reasonable amount would also have a detrimental effect by disrupting the hydropholic/hydrophylic balance of the dispersant. A corollery to the above is that the preferred ranges for the ratio of high molecular weight acylating agent to low and both acylating agents to amine must be controlled to provide a dispersant which is balanced in detergency and gel avoidance.

When tetraethylene pentamine is used, for example, the broad range of acylating groups to amine stated above (molar or equivalent) should leave an average of from 0 percent to 50 wt. percent of the amine groups of the polyamine unreacted. It is preferred, however, to have from 20 to 40 percent of the amine groups that are titratable with hydrochloric acid before acylation still left unreacted after acylation. The most desirable amount left unreacted should be from about 30 to about 40 percent. As use herein, percent unreacted amine is determine by the American Oil Chemists Society (A.O.C.S.) Method Tf lb-64 incorporated herein by reference. The solvents are modified slightly to facilitate seeing the end points, i.e., 80 percent isopropyl alcohol/water is used for tetraethylenepentamine and 90/10 by volume isopropylalcohol/toluene for the dispersants. The error band for this method is about ±3 percent. Such a product would not only give acceptable gel control even with low ratios of high molecular weight acylating agent to the mono-acid but should also still have sufficient polarity (unacylated amine groups) to provide acceptable dispersant capability regardless of whether the amine is a primary, secondary or tertiary amine.

The precise composition of the amide/imide/imidazoline dispersant additive of this invention is not known. The polar portion of the product, however, should be comprised substantially of tertiary amines in heterocyclic rings wherein the ratio of tertiary amine to total amine is about 0.7:1 (as measured by the AOCS method Tf lb-64) and more desirably, at least 0.85:1. The effectiveness of the additive in providing dispersancy is dependant in part on the ratio of the monocarboxylic acid acylating agent to the high molecular weight acylating agent and in part on the ratios of acylating agent to amine. It is also dependent on the reaction conditions under which it is formed.

The temperature and pressure of the final stage of the reaction used to prepare the amine/imidazoline or amine/amide/imidazoline dispersants of this invention is critical to maximizing tertiary amine formation, and generally, reaction temperatures ranging from 120° C. up to the decomposition temperature of any of the reactants or the product and pressures of from 0.1 to 760 mm of Hg absolute can be utilized. Preferably, however, the temperature will be above about 150° C. and more generally from about 150° to about 240° C. The pressures used range generally from about 130 to 760 mm of Hg absolute. The higher the temperature the less need there is to reduce the pressure to eliminate water and form tertiary amines as heterocycles.

The preparation of the amide/imidazoline or amide/imide/imidazoline dispersant of the invention is conducted by reaction of the alkylene polyamine and the carboxylic acylating agent or agents preferably by adding the acids or their equivalents to the amine in a "reverse addition" mode i.e. acylating agent to amine.

The reaction is preferably conducted by the addition of the acid(s) or equivalent to the amine in the "reverse addition" mode, however, the initial addition of the amine to a portion of the carboxylic acid acylating agent or a mixture of the acylating agent(s) followed by the subsequent addition of the remaining acid(s) or the separate addition of the acid(s) in any order is also acceptable.

As indicated above, the optimum raw material addition sequence is to initially add all of the polyalkylenepolyamine. The order of addition of the carboxylic acylating agent and the high molecular weight acylating agent probably has no significant effect on the final product and they may be added simultaneously. However, the "reverse addition" of acid to amine may be impractical due to mixing limitations in a batch reactor. A modification of the preferred mode comprises initially charging some acid(s) to the reactor. Generally, an amount ranging up to 50 percent by volume of the acid(s) is charged to cover the impellers of the reactor. Preferably, the amount charged should be just sufficient to cover the impellers. Then the amine is charged followed by the remaining acid(s). The reactor temperature at the initial charge of acids can range from 80° C. to 150° C. and preferably from 110° C. to 130° C.

The reaction time is dependent upon the size of the charge and the reaction temperature. Generally, after the charging of all the acid to the reactor the reactor temperature is increased to from 140° C. to 160° C. and allowed to soak at reflux generally from about 2 to 4 hours.

It is important that some water be present in the system (produced by acylation) during reflux to maximize the acylation reaction. If water is stripped as produced, the amine/amide groups tend to form heterocycles too soon and this reduces the number of amine groups available for acylation by the acid. Low acid conversion results in an unsatisfactory product. Allowing water to remain directs the reaction towards maximizing acylation of the available amine/amide groups of the polyamine.

After reflux, the temperature is then increased to from about 170° C. to 190° C. for a period of time, generally from 3 to 10 hours during which most of the water formed during the acylation reaction is removed and a residual total acid number of below 10 is obtained.

A small amount of water remains however, which limits cyclization of amide/amine groups. In the final stage, the reactor temperature is again increased, to further remove water including water eliminated by cyclization, to from about 195° C. to about 240° C. with inert gas purge. Alternatively, vacuum stripping may be used at about 150° to about 195° C. for the time required at a reduced pressure of from about 130 to about 250 mm Hg (absolute) with a inert gas bleed. Either method is directed to achieving a tertiary amine to total amine ratio of about at least 0.7:1 or preferably 0.85:1 to 0.95:1. It is desirous to have a free water level below about 0.2 wt. percent, preferably below 0.05 wt. percent in the final product.

Stripping is conducted as disclosed at a temperature and pressure to cause cyclization of remaining ethyleneamine groups with adjacent amide groups. The effect of this conversion to heterocycles containing tertiary amine groups may be measured by following the increase in the tertiary amine or the reduction in primary and secondary amines. With cyclization, the total titratable amine does not change, since only one of the nitrogen atoms in the heterocyclic rings is titratable with HCl. The ring structures or tertiary amine-containing groups are still polar and provide the hydrophilic moieties of the dispersant molecule.

The amide/imidazoline or amide/imide/imidazoline dispersant ranges from about 4 to about 40% by volume in the additive concentrate and preferably from about 5 to about 12 percent by volume of the concentrate.

It was discovered that a more stable product, one which also avoids gel formation is achieved by maximizing the conversion of the amine nitrogen to tertiary amines. The reaction process disclosed above is directed to ultimately decreasing the primary and secondary amine content and increasing the tertiary amine content of the reaction product to the ranges specified above.

(B) The Succinimide Dispersant

The succinimide dispersant of this invention is prepared using a high molecular weight acylating agent and a polyalkylene amine of the type described in the above section on amide/imide/imidazoline dispersants.

The succinimide dispersant are ashless polyalkenyl succinimide dispersants wherein the alkenyl group of the succinic acid or anhydride is derived from a polymer of a $C_3$ or $C_4$ monoolefin especially a polyisobutylene wherein the polyisobutenyl group has a number average molecular weight (Mn) of from 700 to 5,000 more preferably from 900 to 2,500. Such dispersants preferably have at least 1, preferably 1 to 2, more preferably 1.1 to 1.8, succinic groups for each polyisobutenyl group. Such dispersants are disclosed generally in U.S. Pat. Nos. 3,202,678; 3,154,560; 3,172,892; 3,024,195; 3,024,237; 3,219,666, 3,216,936.

Suitable polyamines for reaction with the aforesaid succinic acids or anhydrides to provide the succinimide are those polyalkyleneamines represented by the formula $$NH_2(CH_2)_n—(NH(CH_2)_n)_m—NH_2$$

wherein n is 2 to 3 and m is 0 to 10. Illustrative are ethylene diamine, diethylene trimaine, triethylene tetramine, tetraethylene pentamine, tetrapropylene pentamine, pentaethylene hexamine and the like, as well as the commercially available mixtures of such polyamines. The amines are reacted with the alkenyl succinic acid or anhydride in conventional ratios of about 1:1 to 10:1 moles of alkenyl succinic acid or anhydride to polyamine, and preferably in a ratio of about 2:1.

The preferred acylating agent is a polyisobutylene succinic anhydride prepared using a polybutene fraction with a number average molecular weight ($\overline{M}n$) of from about 900 to 1300. The preferred amine is a polyethylenepolyamine such as tetraethylenepentamine or the so-called "polyamine bottoms" from the polyethyleneamine synthesis.

The succinimide dispersant generally ranges from about 5 to about 50 percent in the additive concentrate and preferably from about 7 to about 15 percent by volume of the concentrate.

Boration of the Dispersants

One or both of the dispersants in the composition of this invention must be reacted with boric acid to provide antiwear properties. The boric acid can be added as a powder or as a suspension of boric acid in oil to the dispersant. An alkyl borate such as tributylborate can also be used. The boration compound used in no way restricts the invention.

The amount of boric acid added to the (A) dispersant depends on its nitrogen content. In broad terms, it can be that amount providing a weight ratio of boron to nitrogen from 0.01:1 to 0.6:1 and preferably from 0.18:1 to 0.26:1.

The reaction is generally accomplished by mixing the dispersant and borating agent and heating them at a temperature of 100° C. to 200° C. and preferably 140° to 160° C. The water formed must be removed preferably by stripping with an inert gas and/or vacuum. The reaction is complete when water is no longer evolved.

The optional use of the phosphorus-containing antiwear agent and the boration of at least one dispersant may allow two-cycle oils to be blended with lower viscosity base oils than would otherwise be the case. These lower viscosity base oils are generally thought to burn more cleanly in the combustion process and leave fewer oil derived residues requiring dispersion.

The borated alkenyl succinimide dispersants are also well known in the art as disclosed in U.S. Pat. No. 3,254,025. These derivatives are provided by treating the alkenyl succinimide with a boron compound selected from the group consisting of boron oxides, boron halides, boron acids and esters thereof, in an amount to provide from about 0.1 atomic proportion of boron to about 10 atomic proportions of boron for each atomic proportion of nitrogen in the dispersant.

The borated product will generally contain 0.1 to 2.0, preferably 0.2 to 0.8 weight per cent boron based upon the total weight of the borated dispersant. Boron is considered to be present as dehydrated boric acid polymers attaching as the metaborate salt of the imide. The boration reaction is readily carried out adding from about 1 to 3 weight per cent based on the weight of dispersant, of said boron compound, preferably boric acid, to the dispersant as a slurry in mineral oil and heating with stirring from 135° C. to 165° C. for 1 to 5 hours followed by nitrogen stripping and filtration of the product.

(C) The Polyolefin Thickener

The 2-cycle additive composition containing the product of this invention also comprises at least one low molecular weight polyolefin having a number average molecular weight ($\overline{M}n$) ranging from about 200 to about 2,000 and preferably from about 225 to about 1300. Suitable polyolefins comprise polyolefins derived from $C_2$ to $C_{12}$ olefins such as polybutene, polyisobutylene, poly-1-octene, poly-1-decene, poly-1-dodecene; copolymers of ethylene with propylene, butene, pentene or hexene, and terpolymers prepared from said lower olefins. Polyolefins are used as thickeners and also enhance the wear protection properties of the oil. Preferred are polyalphaolefins, polybutene and polyisobutylene polyolefins depending on the severity of the operating conditions. Polyisobutylene, for instance, is preferred for light to moderate service whereas polyalphaolefins are preferred in severe conditions due to their better load carrying characteristics.

The polyolefins can be present in the two-cycle additive concentrate in amounts ranging from about 5 to about 60 percent by volume of the concentrate and preferably from about 10 to about 40 percent by volume of the concentrate. It is preferred to use at least two polyolefins of varying molecular weights.

(D) Alkylphenol Sulphides

An optional component of the additive composition or concentrate is an alkylphenol sulphide of the type made by reacting an alkylphenol such as nonyl phenol, dinonylphenol, mixed mono/dialkylphenols, dodecylphenol etc., with commercial sulphur dichloride. Such products are known in the art. The product is principally a mixture of mono and di sulphides as commercial sulphur dichloride frequently contains $S_2Cl_2$.

$$2SCl2 \rightleftharpoons Cl_2 + S_2Cl2$$

Suitable alkylphenol sulphides can also be prepared by reacting alkylphenols with elemental sulphur. Mono and polysulphides are formed in this reaction. The use of alkyl phenyl sulfides in lube oils is also known (see U.S. Pat. No. 929,654 and U.K. Patent No. 591,283 both incorporated herein by reference). However, Applicants have discovered that not all alkyl phenyl sulfides are effective antiwear agents.

The alkylated phenol sulfide preferably comprises an alkyl phenol sulfide in which the alkyl groups range between about $C_6$ and $C_{18}$. Nonyl phenol sulfide is a preferred compound. The concentration of the alkyl hydroxy-aryl sulfide in the additive concentrate can range between about 0.25 and about 5.0 percent by volume, based upon the concentrate, and preferably between about 0.3 and about 0.8 percent by volume. Nonyl phenol sulfide (NPS) is well-known by those skilled in the art and is readily obtainable as an article of Commerce.

(E) The Phosphorus Containing Antiwear

Phophorus containing antiwear additive are known in the art. Such additives include phosphates, $P_2S_5$ treated olefins, phosphorodithioates, etc. Non-limiting examples of the above are a triarylphosphate from FMC corporation, a phosphorus pentasulphide treated alpha pinene such as Exxon Chemicals' ECA 4493 or Ethyl Corporation's HITEC 649 and an ashless phosphorodithioate designated ECA 6330 manufactured by Exxon Chemical. A particularly useful fuel additive has the general formula:

$$\left[ (R^5O)_2\overset{\overset{O}{\|}}{P}O- \right]_x \overset{+}{N}HR^1, R^2, R^3$$

wherein x is 1 or 2, $R^5$ is a $C_8$ to $C_{13}$ hydrocarbyl group, $R^3$ and $R^4$ each are a hydrogen atom or $C_3$ to $C_{12}$ hydrocarbyl group, and $R^2$ is selected from the group consisting of:

(a) $C_8$ to $C_{18}$ hydrocarbyl groups or mixtures thereof, (b) amino hydrocarbyl groups of the formula:

$$\left(CH_2\right)_n NHR^6$$

where x is 1 or $-CH_2-_nN+H_2R^6$ when x is 2, wherein n is 2 or 3 and $R^6$ is (a) above; and (c) alkylene polyamino groups of the formula $$\left(CH_2CH_2NH\right)_m H$$

wherein m is an integer between 2 and 4. Preferably, $R^3$ and $R^4$ are each hydrogen atoms or $C_3$ to $C_4$ alkyl groups, and $R^2$ is (b) wherein $R^6$ is a substantially linear $C_{12}$ to $C_{18}$ aliphatic group. Examples of said amine phosphates include a commercial amine phosphate consisting of an 80 percent solution of amine salt of mixed alkyl acid phosphates in kerosene. In this preferred amine, $R^5$ is the hydrocarbyl portion of a $C_8$ Oxo alcohol, $R^3$ and $R^4$ are H, and $R^2$ is:

$$-CH_2CH_2CH_2N+H_2C_{18}H_{37}$$

Other amine phosphate salts generally suitable for use in the present invention include compounds of the structures: $(C_{13}H_{27}O)_2PO_2NH_3(CH_3)_3CH_3$, $$(C_8H_{17}O)_2PO_2NH_3CH_2\overset{\overset{CH_2CH_3}{|}}{C}H(CH_2)_3CH_3$$

and $(C_8H_{17}O)_2PO_2)_xNH_3-(CH_2CH_2NH)_4-H$ when x is 1, 2 or 3.

The preferred amine salt of mixed alkyl acid phosphates is commercially available as DMA-4 from Petroleum Chemicals, Wilmington, Delaware, E. I. dupont de Nemours & Company.

The amount of phosphorous-containing antiwear compound present in the additive concentrate can range from about 0.1 percent by volume to about 5 percent by volume and preferably about 0.1 to about 0.5 percent by volume based on the concentrate.

As indicated, other additives may be included in the two-cycle formulation as for instance at least one pour point depressant selected from the group consisting of polyalkylacrylates, polyalkylmeth-1 acrylates, alkylfumarate/vinyl acetate copolymers, etc.

Pour point depressants are used to modify the flow properties of the base oil so as to maintain fluidity at subambient temperatures. The temperature at which the two-cycle oil composition of the invention ceases to flow or pour is termed its pour point. It is important that two-cycle oil compositions be capable of flowing freely from reservoirs and through oil lines and filters making up part of the injection lubricating system common in modern two-cycle engines at low temperatures in order to insure proper functioning of the lubricant composition in the engine.

Preferably, the pour point depressant of the two-cycle oil composition is a $C_8$ to $C_{18}$ dialkyl fumarate-vinyl acetate copolymer due to its ability to modify wax in both high and low viscosity base oils. Products with high concentrations of $C_{14}$ and $C_{16}$ alkyl group are favored for floc and gel control.

The amount of the pour point depressant present in the two-cycle oil concentrate can range from about 0.2 to about 5.0 percent weight by volume, preferably from about 0.5 to 2 percent weight by volume based on the concentrate.

The components of the present invention can be incorporated into a lubricating oil in any convenient way. Thus, the compounds or mixtures thereof, can be added directly to the oil by dissolving the same in the oil at the desired level or concentrations. Alternatively, the components can be blended with a suitable oil soluble solvent such as mineral spirits and/or base oil to form a concentrate and then the concentrate may be blended with lubricating oil to obtain the final formulation. Such component concentrates will typically contain (on an active ingredient (A.I.) basis) from about 30 to about 100 wt. percent, and preferably from about 50 to about 85 wt. percent of the additive package the remaining being, for instance, a diluent.

A typical additive concentrate contains:

1) 4–40 vol. percent of the amide/imide/imidazoline dispersant.

2) 5–50 vol. percent of the succinimide dispersant; at least one of the dispersants (i) or (ii) being borated.

3) 1–60 volume percent of a polyolefin thickener, and optionally.

4) 0.1–5.0 volume percent of the alkylphenol sulphide, and 5) 0.1–5.0 vol. percent of the phosphorous-containing antiwear agent.

Treat rates for the additive package in finished oil can range from about 5 to about 60 percent by volume and preferably from about 35 to about 50 percent by volume of the concentrate.

Other additives may be added to the two-cycle oil composition or concentrate in accordance with the invention claimed to impart other desirable properties thereto. For example, there may be added anti-oxidants, V.I. improvers, thinners and anti-rusts agents. Aspects of the inventions disclosed in copending applications docket nos. PT-911 and PT-913 can be incorporated in the compositions of the instant invention to enhance gel avoidance.

The invention is more fully delineated in the following Examples.

EXAMPLE 1

Synthesis of Amide/Imide/Imidazoline Dispersant

Emersol 872 isostearic acid (ISA) (883.0 gram; 2.8 mole based) on an acid number of 178 mg KOH/g) and an 80/20 mixture by weight of polyisobutyenyl succinic anhydride (PIBSA) in solvent 150 Neutral (318.5 gram; 2.5 mole of anhydride) were blended together in a beaker at 80° C. One half the mixture was added to a 3 liter glass reaction flask fitted with a magnetic stirrer, heating mantel thermocouple and reflux condenser, Union Carbide ultra high purity grade tetraethylenepentamine (TEPA) (189 gram; 0.15 mole based on a molecular weight of 224 from a total amine value of 1250 mg KOH/g) was added with stirring over 30 minutes. The temperature was increased to 120° C. from the heat of reaction. The other half of the acid/anhydride mixture was then added to the reaction flask over 10 minutes. Heat was applied to bring the temperature to 150° C. Some water vapor was vented from the flask as the temperature was increased to 150° C. to minimize foaming and bumping. Thereafter, the temperature was maintained at 150° C. under water reflux for four hours. Twice during the four hours, some more water was released to hold temperature and control foaming.

After four hours, the heat was shut off and the system blanketed with nitrogen overnight. The next day, a Deane-Stark trap was inserted between the flask and the condenser and a $N_2$ bubbler was inserted below the liquid surface in the flask. The temperature was increased slowly to 180° C. and held there for four hours. During that time, 29 ml of water collected in the trap.

The trap was then removed and the temperature increased to 190°–192° C. House vacuum was applied ($^{18}$20 inches of mercury differential) and the product vacuum stripped with a $N_2$ bleed for 70 minutes. The system was then shut down and the product weighed (1312 g). It had a residual acid number of 5.3 mg KOH/g; the total amine value was 60 and the tertiary amine value was 49 mg KOH/g.

EXAMPLE 2

Boration of an Amide/Imide/Imidazoline Dispersant

A dispersant similar to that described in Example 1 but made in a commercial plant using Unichema PRISORINE® 3502 isostearic acid and having a total amine value of about 68 (100 g) and a 15 wt. percent suspension of boric acid in oil (46.8 g) were added to a 250 ml 3-neck flask fitted with a magnetic stirrer, heating mantel and thermocouple.

The temperature was increased slowly, to control foaming to 110° C. with the flask vented to the atmosphere. Most of the water of reaction condensed in the upper portion of the flask. A $N_2$ bubbler was then inserted below the liquid level in the flask and the upper portion of the flask insulated. Most of the water was stripped from the reaction product in 30 minutes. Vacuum was then applied (about 20 inches of mercury differential) and the last of the water removed by vacuum stripping with a $N_2$ bleed.

The product recovered weighed 142.6 grams. The calculated active ingredient level was 72.1 wt. percent. The calculated boron content was 1.17 percent. The nitrogen/boron weight ratio was 4.53:1.

EXAMPLE 3

Oil comparisons were conducted using a Falex Wear Tester test to illustrate the antiwear properties of an amine phosphate and borated dispersants.

A Falex test procedure was used (a modification of ASTM 2760) in which the load was held constant at 500 lbs. for 2 ½ hours. Upon completion of the test the amount of wear to the #8 ASTM pin (and optionally the VEE blocks) was measured. The oil in the lubricant cup had reached a temperature of 77° C. when the test ended.

This test indicates how well a lubricant will control severe boundary wear in an oil rich environment such as that found in the lower end of a two-cycle engine.

Results for a series of oils are shown in Table 1. They illustrate that boration of either dispersant of this invention provides a dramatic improvement in wear control as compared to dispersants which were not borated. The oil did not complete the test.

TABLE 1

FALEX WEAR TESTS TO ILLUSTRATE THE ANTIWEAR PROPERTIES OF THE COMPOSITION OF THE INVENTION

| OIL CODE | 1 | 2 | 3 | 4 | 5 |
|---|---|---|---|---|---|
| FORMULATION, LV % | | | | | |
| Borated succinimide(1) | — | 10.0 | — | — | 10.0 |
| Non-borated succinimide | 10.0 | — | 10.0 | 10.0 | — |
| Borated amide/imide/imidazoline | — | — | 11.3(2) | — | — |
| Non-borated above | 8.0 | 8.0 | — | 8.0 | 8.0 |
| Nonylphenl sulfide (NPS) | 0.5 | 0.5 | 0.5 | 0.5 | 0.5 |
| Amine phosphate (DMA4) | — | — | — | 0.5 | 0.3 |
| 950 Mn polybutene | 7.0 | 7.0 | 7.0 | 7.0 | 7.0 |
| 1300 Mn Polybutene | 5.0 | 5.0 | 5.0 | 5.0 | 5.0 |
| Pour depressant | 0.3 | 0.3 | 0.3 | 0.3 | 0.3 |
| Solvent 160N base oil | 53.2 | 53.2 | 49.9 | 52.7 | 52.9 |
| Light solvent | 16.0 | 16.0 | 16.0 | 16.0 | 16.0 |
| FALEX WEAR TEST(3) | FAIL(4) | | | | |
| Wear on PIN, mg | — | 5.0 | 9.6 | 17.1 | 19.1 |
| Wear on VEE Block −1 | — | — | 0.4 | 0.9 | — |
| VEE Block −2 | — | — | 0.3 | 0.8 | — |

(1)Paranox 106 - Exxon Chemical which is a borated product of polyisobutylene succinic anhydride and polyethyleneamine as discussed herein.
(2)72.1 wt. % active ingredient - Isostearic acid/polyisobutylene/tetraethylene (ISA/PIBSA/TEPA) which was borated.
(3)Modified ASTM 2670 procedure; 500 LB applied load; 2½ hours duration; measure wear on pin and VEE Blocks; #8 ASTM 3135 steel pin and ASTM 1137 steel VEE Blocks.
(4)Sheared the brass shear pin in 12 minutes.

EXAMPLE 6

This example compares the two dispersant additive composition of the instant invention exemplified by Examples 4 and 5, with a two-cycle oil composition containing a single dispersant (Example 6). Testing was done as shown. The 40 hp OMC test is a standard test run within the National Marine Manufacturers Association (NMMA) guidelines. The Yamaha-Y350M2 test is ASTM test D-4857.

The field testing was done on two 155 hp engines mounted side by side and run for 300 hours in normal commercial operation. The engines were then dismantled and rated. Higher ratings in each category (Table 2) indicated superior results.

EXAMPLES 4-6

TABLE 2

| | Example 4 | Example 5 | Example 6 |
|---|---|---|---|
| ISA/PIBSA/TEPA | 8.0 | 7.0 | 8.6 |
| Borated PIBSA PAM (1) | 10.0 | 10.0 | — |
| Polybutene (2) | 12.0 | 12.0 | 4.5 |
| Nonyl Phenol Sulfide (NPS) | 0.5 | 0.5 | — |
| Wax Crystal Modifier (3) | 0.3 | 0.3 | 0.3 |
| Anti-Wear Agent (DMA4) | 0.2 | 0.2 | — |
| Bright Stock Solvent | 16.0 | 17.0 | 5.9 |
| S160N Basestock | 53.0 | 53.0 | 80.7 |
| TC-WII Testing | | | |
| HP OMC | | | |
| Top Ring Sticking | 9.2 | 9.2 | 9.5 |
| Avg Piston Varnish | 8.9 | 8.4 | 7.8 |
| Tightening Improvement, % Vs. TC-WII Ref. | 30.7 | 17.4 | 2.3 |
| TC Testing | | | |
| Y-350M2 | | | |
| Top Ring Sticking | 10.0 | 10.0 | 10.0 |
| 2nd Ring Sticking | 9.0 | 7.8 | 8.5 |
| Avg Piston Varnish | 9.2 | 9.2 | 7.6 |
| Field Testing | | | |
| 300 hrs in OMC 155 hp | | | |
| Avg Top Ring Sticking | 9.75 | | 9.73 |
| Avg 2nd Ring Sticking | 8.76 | | 7.76 |
| Avg Piston Skirt Varnish | 7.16 | | 6.66 |
| Avg Piston Skirt Scuffing | 9.54 | | 9.22 |
| Avg Crownland | 8.31 | | 7.81 |
| Avg 2nd Land | 8.51 | | 7.88 |
| Avg Undercrown | 6.16 | | 5.30 |

(1) Commercial product Paranox 106 - Exxon Chemical Company
(2) Parapol 950 and Parapol 1300 - Commercially available from Exxon Chemical Company
(3) Paraflow 384 - Exxon Chemical Company

EXAMPLE 7-9

Examples 7 and 8 were compositions prepared in accordance with the invention. Example 9 represents a TC-WII standard oil finished oil additive. The Tightening Test is an NMMA sanctioned test used in certifying TC-WII and TC-WIII oils. The results are shown in Table 3.

EXAMPLE 7-9

TABLE 3

| | Example 7 | Example 8 | Example 9 |
|---|---|---|---|
| ISA/TEPA/PIBSA | 8.6 | 8.6 | 11.0 |
| Borated PIBSA (1) | 7.5 | 7.5 | — |
| Polybutene | 9.5 | 4.5 | 5.0 |
| Nonyl Phenol Sulfide (NPS) | — | — | — |
| Wax Crystal Modifier (2) | 0.3 | 0.3 | — |
| Anti-Wear Agent | — | — | — |
| Solvent | 11.9 | 11.4 | 15.0 |
| Bright Stock | — | 10.0 | 10.0 |
| S100N Low Pour Basestock | 62.2 | 57.7 | 59.0 |
| TC-W3 Testing | 14.90 | 7.09 | 3.10 |
| Tightening Improvement, % Vs. TC-W3 Ref. | | | |

(1) Paranox 106 - Exxon Chemical Company
(2) Paraflow 384 - Exxon Chemical Company

What is claimed is:

1. A two-cycle oil additive comprising a dispersant (A) which is the reaction product of a polyalkylene polyamine, at least one monocarboxylic acid acylating agent and optionally at least one high molecular weight carboxylic acid acylating agent; and (B) at least one succinimide dispersant and (C) a polyolefin thickener, and wherein at least one of the dispersants is borated.

2. The two-cycle oil additive of claim 1 further comprising (D) an alkylated phenol sulfide and optionally (E) a phosphorous-containing anti-wear compound.

3. The two-cycle oil additive of claim 1, wherein the dispersant (A) has a tertiary amine to total amine ratio of at least 0.7:1.

4. The two-cycle additive of claim 3 wherein the tertiary amine to total amine ratio is at least 0.85:1.

5. The two-cycle oil additive of claim 1 wherein the dispersant (A) has a the molar ratio of monocarboxylic acid to high molecular weight acylating agent range of at least 3:1.

6. The two-cycle oil additive of claim 5, wherein the molar ratio of monocarboxylic acid to high molecular weight acylating agent ranges from 5:1 to 59:1.

7. The two-cycle oil additive of claim 6, wherein the molar ratio of monocarboxylic acids acylating agent to high molecular weight acylating agent ranges from about 5:1 to 12:1.

8. The two-cycle oil additive of claim 1, wherein the dispersant (A) has a ratio of acylating agent(s) to polyalkylene amine at from 3.5:1 to 4.5:1.

9. The two-cycle oil additive of claim 1, wherein the high molecular weight acylating agent has a number average molecular weight of from 700 to 4,000.

10. The two-cycle oil additive of claim 9, wherein the high molecular weight acylating agent is polyisobutylene succinic acid or anhydride.

11. The two-cycle oil additive of claim 1, wherein the monocarboxylic acid acylating agent is isostearic acid.

12. The two-cycle oil additive of claim 1, wherein the polyalkylenepolyamine has the formula:

$$H_2N(\underset{\underset{R_1}{|}}{R}NH)_nH$$

wherein R is a $C_2$ to $C_3$ alkylene radical, $R^1$ can be hydrogen or an alkyl radical of from about 1 to about 16 carbon atoms and n is an integer of one or greater.

13. The two-cycle oil additive of claim 12, wherein the polyamine is tetraethylene pentamine.

14. The two-cycle oil additive of claims 1 and 2 wherein dispersant (A) is borated.

15. The two-cycle oil additive of claim 1, wherein the succinimide dispersant is a reaction product of polyisobutylene succinic acid or anhydride and a polyethyleneamine.

16. The two-cycle oil additive of claim 15, wherein the ratio of polyisobutylene succinic acid or anhydride to amine is 2:1.

17. The two-cycle oil additive of claim 15, wherein the succinimide dispersant is borated.

18. The two-cycle oil additive of claim 1, wherein the polyolefin thickener has a number average molecular weight ranging from about 200 to about 2000.

19. The two-cycle oil additive of claim 18, wherein the polyolefin thickener is a copolymer obtained from the polymerization of olefins selected from $C_2$ to $C_{12}$ olefins.

20. The two-cycle oil additive of claim 18, wherein the polyolefin thickener is a terpolymer derived from the polymerization of olefins selected from $C_2$ to $C_{12}$ olefins.

21. The two-cycle oil additive of claim 18 wherein the polyolefin is polybutene.

22. The two-cycle oil additive of claim 18, wherein the polyolefin thickener is a polyisobutylene.

23. The two-cycle oil additive of claim 18, wherein the polyolefin thickener is a polyalphaolefin.

24. The alkylated phenol of claim 2, wherein the alkyl phenol sulfide is derived from a nonyl phenol.

25. The two-cycle oil additive of claim 2, wherein the phosphorous-containing anti-rust composition is an amine salt of a mixed alkylated phosphate.

26. The two-cycle oil additive of claim 1, wherein the polyalkylene polyamine of (A) has the formula:

$$H_2N(\underset{\underset{R^1}{|}}{-R}-NH)_mH$$

wherein R is a $C_2$ to $C_3$ alkylene radical, $R^1$ can be hydrogen or an alkyl radical of from 1 to about 16 carbon atoms and n is an integer of one or greater.

27. A two-cycle oil additive composition containing a two-cycle oil and from 5 to 60 volume percent of a two-cycle oil additive concentrate comprising a dispersant (A) which is the reaction product of a polyalkylene polyamine, at least one monocarboxylic acid acylating agent and optionally at least one high molecular weight carboxylic acid acylating agent; (B) at least one succinimide acylating agent dispersant and (C) a polyolefin thickener, and wherein at least one of the dispersants is borated.

28. The two-cycle oil composition of claim 27, further comprising (D) an alkylated phenol sulfide and optionally (E) a phosphorous-containing anti-wear compound.

29. The two-cycle oil composition of claim 27, further comprising a pour point depressant.

30. The pour point depressant of claim 29 which is an alkyl fumarate vinyl acetate copolymer wherein the alkyl groups range from $C_8$ to $C_{18}$.

31. The two-cycle oil composition of claim 27 wherein dispersant (A) is the reaction product of isostearic acid and tetraethylene pentamine.

32. The two-cycle oil composition of claim 31 wherein dispersant (A) is the reaction product of isostearic acid, tetraethylenepentamine and polyisobutylene succinic anhydride.

33. The two-cycle oil composition of claim 32 wherein the total amine to tertiary amine ratio of tertiary amine ratio of at least 0.7:1.

34. The two-cycle oil composition of claim 33 wherein the total amine to tertiary amine ratio of dispersant (A) is at least 0.85:1.

35. The two-cycle oil composition of claim 32 wherein the ratio of isostearic acid to polyisobutylene succinic anhydride is at least 3:1.

36. The two-cycle oil composition of claim 35 wherein the ratio of isostearic acid to polyisobutylene succinic anhydride ranges from about 5:1 to 12:1.

37. The two-cycle additive composition of claim 27 wherein the dispersant (A) has a ratio of acylating agent(s) to polyalkylene amine of from 3.5:1 to 4.5:1.

38. The two-cycle additive composition of claim 27 wherein the optional high-molecular weight acylating agent of (A) has a number average molecular weight of from 700 to 4,000.

39. A two-cycle oil concentrate comprising from:

1) 4–40 percent by volume of an amide/imide/imidazoline dispersant or amide/imidazoline dispersant,
2) 5–50 percent by volume of a succinimide dispersant; wherein at least one of the dispersants is borated,
3) 1–60 percent by volume of a polyolefin thickener, and optionally,
4) 0.1 to 5.0 percent by volume of an alkylphenol sulfide; and/or
5) 0.1 to 5.0 percent by volume of a phosphorous-containing antiwear agent.

* * * * *